US005999087A

United States Patent [19]

Gunton

[11] Patent Number: 5,999,087

[45] Date of Patent: Dec. 7, 1999

[54] TIMER AND ALARM APPARATUS FOR CONTROLLING DELIVERY OF FLUID MATERIAL

[76] Inventor: Bruce Stanley Gunton, 2 Deansbank Centre, Fairground Way, Walsall, West Midlands WS1 4NV, United Kingdom

[21] Appl. No.: 09/212,937

[22] Filed: Dec. 18, 1998

[51] Int. Cl.[6] ..... N01N 37/36

[52] U.S. Cl. ..... 340/309.5; 340/825.69; 340/825.72; 340/539; 340/309.15; 222/23; 222/639; 137/889; 251/129.04

[58] Field of Search ..... 340/309.5, 825.69, 340/825.72, 539, 309.15; 222/23, 639; 137/889; 251/129.04

[56] References Cited

U.S. PATENT DOCUMENTS 3,974,879 8/1976 Nelson, Jr. et al. ..... 169/43
5,263,824 11/1993 Waldbeser et al. ..... 417/10
5,634,778 6/1997 Liegel et al. ..... 417/313

*Primary Examiner*—Jeffery A. Hofsass
*Assistant Examiner*—Tai Tan Nguyen
*Attorney, Agent, or Firm*—Smith-Hill and Bedell

[57] ABSTRACT

Apparatus is described for controlling delivery of dangerous material, such as LPG, from a tanker 12 to a tank 14, through a pipe 16. A valve 18 is controlled by an arrangement 22. An operator 28 carries a radio transmitter 24 and must periodically transmit an appropriate signal to the control 22, otherwise the control 22 will time out and close the valve, also sounding an alarm. In accordance with the invention, the transmitter 24 is also provided with a timer, having a shorter count down time, and also re-set when the signal is sent to the control 22. The timer in the transmitter 24 alerts the operator 28 that a signal should be sent, giving the operator an opportunity to send a signal before the control 22 closes the valve 18. However, if the operator does not send a signal, or is incapable of doing so, the timer at 22 will assume that an emergency situation exists, and cease further delivery.

12 Claims, 1 Drawing Sheet

TIMER AND ALARM APPARATUS FOR CONTROLLING DELIVERY OF FLUID MATERIAL

The present invention relates to apparatus for controlling delivery of flammable material, particularly but not exclusively from a delivery vehicle to a storage container.

Liquid propane gas (LPG) is a common form of fuel, particularly for domestic use. It is customary for this to be stored on the premises in a storage container which is replenished periodically from a road vehicle, called a tanker. Filling the storage container from the tanker is a potentially hazardous operation, in view of the flammable and/or explosive nature of LPG. Similar arrangements and problems arise with other fuels of this nature.

The invention provides apparatus for controlling delivery of fluid material from a delivery vehicle to a storage container, the apparatus comprising valve control means associated with the vehicle and operable to control at least one valve, being a delivery valve for the said material, portable control means operable from a location remote from the vehicle to transmit control signals to the valve control means in response to manual actuation, the valve control means being operable to close the valve unless a control signal is received from the portable control means within a predetermined time of a previous control signal being received, and there being alarm means associated with the portable control means, and operable to alert an operator if an appropriate manual actuation to transmit a control signal has not occurred with a second predetermined time of a previous actuation.

The said material may be flammable.

The second predetermined time is preferably shorter than the first. First timer means are preferably associated with the portable control means and are re-set each time a control signal is transmitted. The first timer means may comprise a count down timer which is re-set as aforesaid, and which activates the said alarm means upon counting down. The second timer means may be associated with the valve control means and re-set each time a control signal is transmitted. The second timer means may be a count down timer which is re-set as aforesaid and which activates the valve control means upon counting down, to cause the valve to be closed.

There may be second alarm means operable in the event of the valve being closed.

Control signals may be transmitted by wireless means. Control signals may be transmitted by radio.

The first alarm means are preferably actuable to provide an audible, visible and/or tactile alarm signal detectable by an operator.

The valve control means may be further operable to shut down the vehicle engine.

Figure 1:
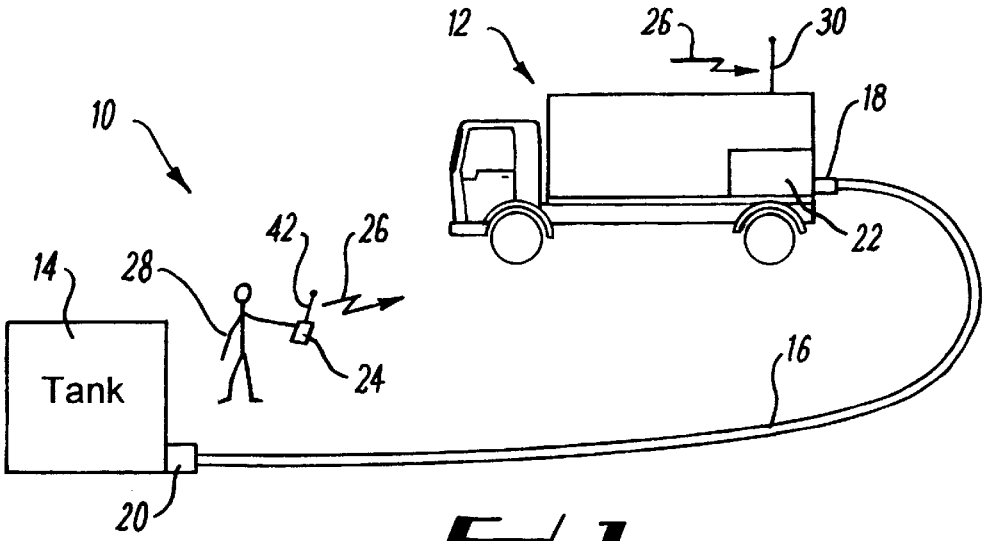
Figure 2:
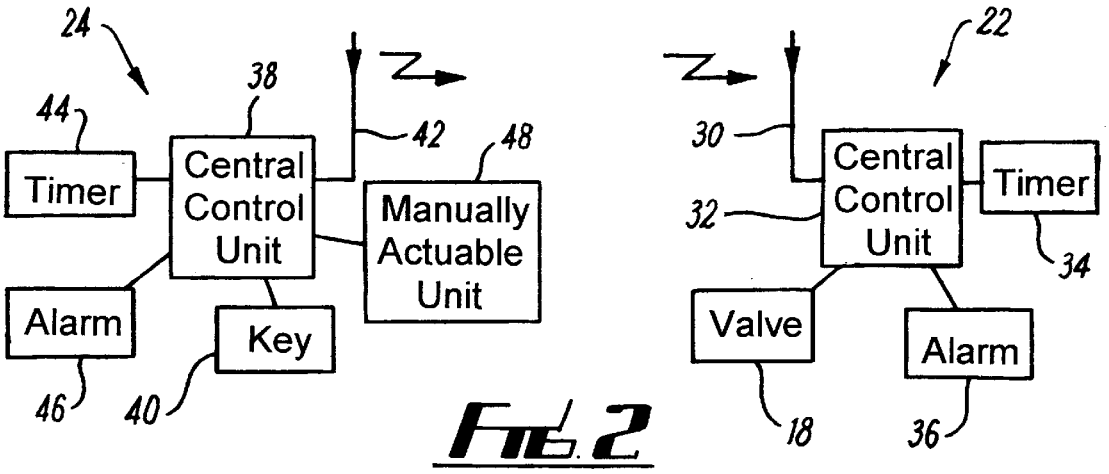

An embodiment of the present invention will now be described in more detail, by way of example only, and with reference to the accompanying drawings, in which:

FIG. 1 is a highly schematic diagram of apparatus according to the invention, in use while a tanker is replenishing a storage container; and FIG. 2 is a highly simplified block diagram of the valve control means and portable control means of the invention.

Turning to FIG. 1, there is shown schematically apparatus 10 for controlling delivery of fluid material (such as LPG) from a delivery vehicle or road tanker 12 to a storage tank 14. LPG is conveyed from the tanker 12 to the tank 14 through a pipe 16 controlled at the tanker end by a valve 18, and usually connected through a second valve 20 to the tank 14. Thus, the valve 18, in particular, can be opened or closed to control delivery of LPG through the pipe 16.

The condition of the valve 18 (and other valves, if present) is controlled by a valve control system 22 on-board the tanker 12, as will be described.

A remote control unit 24, preferably hand-held, can be operated from a location remote from the vehicle to transmit control signals (indicated schematically by arrows 26) to the system 22 in response to manual actuation of the remote unit 24 by an operator 28.

For safety reason, the control system 22 is arranged to close the valve 18 unless control signals 26 are received from the remote unit 24 within a predetermined time of a previous control signal being received. Conventionally, this process of shutting down delivery is accompanied by a noisy alarm and possibly also by flashing lights, to alert the operator 28 to the situation, in the event that he has forgotten to send a control signal, or to alert passers-by in the event that a control signal has not been sent because of accident, illness or injury to the operator 28.

In some circumstances, the noise and lights associated with the system 22 shutting down the valve 18 is considered undesirable, particularly if it arises unnecessarily, such as through an oversight of the operator, rather than as a result of a genuine danger arising from accident, illness or injury. If a control signal is delayed merely because of forgetfulness on the part of the operator 28, unnecessary disturbance to nearby properties or neighbours can be the result. In addition, the operator 28 will find the system 22 inconvenient if it is necessary to go back to the tanker 12 in order to re-set the alarm.

However, the apparatus according to the invention allows the delivery arrangements to be used more conveniently, but it is believed without any prejudice to safety, as follows.

First, the system 22 has an aerial 30 to receive incoming radio transmissions from the unit 24. These are received and decoded, as necessary, by a central control unit 32 which has associated with it a timer 34 and an alarm 36, and can control the valve 18. The unit 32 may be microprocessor based, or implemented in other technologies. Its function is to detect an incoming signal 26 and to act on it if it includes instructions, such as to open or close the valve 18. In the event that the valve 18 is to be opened, the system 22 will also trigger the timer 34 to begin counting a first predetermined period, which may be thirty seconds. If no further signal 26 is received from the remote unit 24, within the predetermined time, the unit 32 will interpret this as a danger situation, and activate the alarm 36, which may produce an audible signal (such as a siren) and a visible signal (such as a strobe light). The system 22 will also shut down the valve 18 and may also shut down the vehicle engine.

If a signal 26 is received within the thirty second period, the timer 34 is re-set, and begins to count a further period.

Thus, in this example, if the system 22 does not received a signal 26 at least every thirty seconds, the supply of LPG from the tanker 12 will be halted.

At the remote unit 24, which preferably hand-held and thus readily carried by the operator 28, there is a central control unit 38 which can be instructed from keys 40 to send signals 26 through an aerial 42 to the system 22, such as instruction to open or close the valve, or make other modifications to the delivery arrangements. A second timer 44 is associated with the unit 38, which also has an associated alarm 46 and a manually actuable "continue" control 48.

Each time a signal is instructed by the keys 40 or control 48, the unit 38 re-sets the timer 44 to begin timing a second predetermined period, preferably shorter than the period timed by the timer 34, such as twenty seconds. Once the timer 44 has counted down, the unit 38 will sound the alarm 46 if no further actuation of the keys 40 or continue control 48 has occurred. The alarm 46 may provide a visual, audible or tactile alarm to the operator 28, but is preferably more muted than the alarm 36, to be readily detectable by the operator 28, but not such as to disturb others in the vicinity. The purpose of this alarm 46 is merely to alert the operator 28 to the expiry of the time measured by the timer 44, not to alert passers by to a danger, as the alarm 36 is intended to do.

If another signal is sent within the second predetermined period, either from a key 40 or the continue control 48, the timer 44 re-sets and continues counting. Operation of the continue control 48 allows the timer 44 to be re-set, and sends a signal 26 whose only effect at 22 is to re-set the time 34. Operation of the keys 40 will re-set both timers and also instruct some other action at the tanker 12.

Since the second period is shorter than the first period, but both begin together (when a signal 26 is sent from the unit 24 and received by the system 22), the alarm 46 will be activated before the alarm 36, but neither will be activated if a further actuation of the keys 40 or control 48 has occurred before the alarm 46 is activated.

If the operator 28 forgets to use at least the control 48 to send a "continue" signal confirming his alertness, he will first be reminded by the alarm 46 and then have a short period (in this example ten seconds) in which to ensure that a signal is sent to the system 22. If he has merely forgotten to send a signal, or has been distracted, but the situation is not otherwise unsafe, this reminder will be sufficient to restore safe operation of the arrangements without having sounded the main alarm 36.

However, if the alarm 46 does not stimulate the operator 28, no signal 26 will be sent, and the timer 34 will continue to run down until eventually, the alarm 36 will sound, indicating that something is amiss, with consequent likelihood of a safety problem. This assumption can be made because the operator will not have responded to the alarm 46 and can thus be assumed to be either injured, ill or otherwise incapacitated, or to have ceased to concentrate on controlling the delivery, and thus be inadequately attentive to the safety of the situation.

It can thus be seen that by providing the timer and alarm in the remote unit 24, operation of the main alarm 36 can be avoided unless it is reasonable to assume that a danger situation has arisen. False alarms arising from absent mindedness and the like should not occur, in view of the reminder given to the operator, and the additional time allowed after the reminder, in which to send a signal.

It will be apparent that very many variations and modifications can be made to the apparatus described above, without departing from the scope of the present invention. First, the apparatus can be modified for use with delivery of very many other types of fluid material, including liquids and powders, and dangerous or flammable material, including petroleum, and can be applied to vehicles other than road vehicles, such as ships, water-borne tankers and the like. Similar arrangements can be implemented at a smaller or larger scale.

Transmission from the remote unit 24 to the system 22 has been described as wireless, preferably by radio, but could be through a conductor or "umbilical cord" according to the requirements and convenience of the situation. Many different technologies could be used to implement the functions described above, particularly this in relation to FIG. 2, and it is within the skill of the skilled reader to devise appropriate arrangements.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. Apparatus for controlling delivery of fluid material from a delivery vehicle to a storage container, the apparatus comprising valve control means associated with the vehicle and operable to control at least one valve, being a delivery valve, for the said material, portable control means operable from a location remote from the vehicle to transmit control signals to the valve control means in response to manual actuation, the valve control means being operable to close the valve unless a control signal is received from the portable control means within a predetermined time of a previous control signal being received, and there being alarm means associated with the portable control means, and operable to alert an operator if an appropriate manual actuation to transmit a control signal has not occurred within a second predetermined time of a previous actuation.

2. Apparatus according to claim 1, wherein the said material is flammable.

3. Apparatus according to claim 1, wherein the second predetermined time is shorter than the first.

4. Apparatus according to claim 1, wherein first timer means are associated with the portable control means and are reset each time a control signal is transmitted.

5. Apparatus according to claim 4, wherein the first timer means comprise a count down timer which is reset as aforesaid, and which activates the said alarm means upon counting down.

6. Apparatus according to claim 1, wherein second timer means is associated with the valve control means and is reset each time a control signal is transmitted.

7. Apparatus according to claim 6, wherein the second timer means is a count down timer which is reset as aforesaid and which activates the valve control means upon counting down, to cause the valve to be closed.

8. Apparatus according to claim 1, further comprising second alarm means operable in the event of the valve being closed.

9. Apparatus according to claim 1, wherein control signals are transmitted by wireless means.

10. Apparatus according to claim 9, wherein control signals are transmitted by radio.

11. Apparatus according to claim 1, wherein the first alarm means are actuable to provide an audible, visible or tactile alarm signal detectable by an operator.

12. Apparatus according to claim 1, wherein the valve control means are further operable to shut down the vehicle engine.

* * * * *

UNITED STATES PATENT AND TRADEMARK OFFICE
CERTIFICATE OF CORRECTION

PATENT NO. : 5,999,087
DATED : December 7, 1999
INVENTOR(S) : Bruce Stanley Gunton It is certified that error appears in the above-identified patent and that said Letters Patent is hereby corrected as shown below:

Cover Sheet, left column, "[22] Filed: Dec. 18, 1998" should be deleted and replaced with --[22] Filed: Dec. 16, 1998--.

Cover Sheet, left column, between [22] and [51] should be inserted

--[30] Foreign Application Priority Data

Dec. 20, 1997 [UK] United Kingdom.....9726830.4--

Signed and Sealed this

Twenty-ninth Day of August, 2000

*Attest:*

*Attesting Officer*

Q. TODD DICKINSON

*Director of Patents and Trademarks*